US006408723B1

(12) United States Patent
Zurbuchen

(10) Patent No.: US 6,408,723 B1
(45) **Date of Patent: *Jun. 25, 2002**

(54) INSULATING COMPOSITE SHAFT TOOL WITH INTERCHANGEABLE HEADS AND METHOD OF CONSTRUCTION THEREOF

(75) Inventor: Gregory A. Zurbuchen, Kenosha, WI (US)

(73) Assignee: Snap-on Technologies, Inc., Lincolnshire, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/627,935

(22) Filed: Jul. 28, 2000

(51) Int. Cl.[7] ..... B25B 13/02
(52) U.S. Cl. ..... 81/119; 81/177.2; 81/900
(58) Field of Search ..... 81/119, 117.1, 81/177.2, 177.85, 438, 490, 900, DIG. 8

(56) References Cited

U.S. PATENT DOCUMENTS

| | | | | |
|---|---|---|---|---|
| 463,044 | A | | 11/1891 | Hammack |
| 556,151 | A | | 3/1896 | Johnson |
| 562,709 | A | | 6/1896 | Courtright et al. |
| 776,459 | A | | 11/1904 | Gage |
| 1,122,915 | A | | 12/1914 | Hallum |
| 1,314,044 | A | | 8/1919 | Buker |
| 1,370,839 | A | | 3/1921 | Redenbaugh |
| 1,424,676 | A | | 8/1922 | Parsons |
| 1,550,564 | A | | 8/1925 | Nagano |
| 1,564,222 | A | | 12/1925 | Dunlap |
| 1,819,525 | A | | 8/1931 | Schaefer |
| 2,376,575 | A | | 5/1945 | Cronan |
| 2,832,246 | A | * | 4/1958 | Livermont ..... 81/DIG. 8 X |
| 2,909,954 | A | | 10/1959 | Rhoads |
| 3,270,597 | A | * | 9/1966 | Neff et al. ..... 81/177.2 X |
| 3,738,203 | A | | 6/1973 | Cudd |
| 3,742,788 | A | | 7/1973 | Priest |
| RE28,964 | E | | 9/1976 | Nunes et al. |
| 4,130,032 | A | | 12/1978 | Giandomenico et al. |
| 4,738,169 | A | | 4/1988 | Wyka |
| 5,038,644 | A | | 8/1991 | Delsack |
| 5,052,253 | A | | 10/1991 | Lin |
| 5,062,328 | A | | 11/1991 | Demurger |
| 5,172,614 | A | | 12/1992 | Monnet et al. |
| 5,259,277 | A | * | 11/1993 | Zurbuchen ..... 81/177.1 |
| 5,331,869 | A | | 7/1994 | Webb |
| 5,557,992 | A | | 9/1996 | Macor |
| 5,685,208 | A | * | 11/1997 | Tidwell ..... 81/177.2 X |
| 5,732,605 | A | | 3/1998 | Mann |
| 5,904,080 | A | * | 5/1999 | Anderson et al. ..... 81/438 X |
| 5,996,453 | A | | 12/1999 | Blacklock |
| 6,016,726 | A | | 1/2000 | Wright |
| 6,021,694 | A | | 2/2000 | Beger |
| 6,216,566 | B1 | * | 4/2001 | Zurbuchen ..... 81/177.1 X |

FOREIGN PATENT DOCUMENTS

| | | |
|---|---|---|
| EP | 0 747 178 | 12/1996 |

* cited by examiner

*Primary Examiner*—James G. Smith
(74) *Attorney, Agent, or Firm*—Seyfarth Shaw

(57) ABSTRACT

An electrically insulating hand tool is comprised of a two-piece shaft formed by a tube and a rod received by the tube, a handle connected to the rod, an insert received in an end of the tube opposite the rod, and a work engaging head detachably coupled to the insert. The tube and the rod are formed of an electrically insulating non-metallic composite material.

12 Claims, 4 Drawing Sheets

INSULATING COMPOSITE SHAFT TOOL WITH INTERCHANGEABLE HEADS AND METHOD OF CONSTRUCTION THEREOF

BACKGROUND OF THE INVENTION

The subject matter of this application relates to hand tools of the type which are electrically insulating so that they can be safely used in applications where they may come into contact with sources of electrical power. More specifically, the subject of this application is an electrically insulating hand tool having a two-part shaft made of composite materials, a handle connected thereto, an insert received by the shaft and a work-engaging head which detachably couples to the insert.

There are tools in the prior art which can be used on or around sources of electrical power. Most are typically formed of metal materials but have an insulated coating thereon or otherwise are covered with insulating materials. These tools are also typically connected to handles made from electrically insulating materials.

These tools generally work to electrically insulate a user from electricity; however, there is a danger that the insulation on these tools will become damaged, compromising the tool's ability to insulate a user from electricity. Therefore, the use of these tools in or around electrical sources may put the user at risk for electrical shock. As a result, these tools are not generally recommended for use around or on components involving high voltages.

There are also tools in the prior art that are manufactured from plastic materials. These tools can provide greater electrical insulating capabilities than the insulated tools; however, these tools often lack the bending and/or torque strength of their metal counterparts. Consequently, they may break or deform when used in high torque applications.

SUMMARY OF THE INVENTION

Generally, this application relates to an improved electrically insulating tool which avoids the disadvantages of the prior art while affording additional structural and operating advantages.

An important feature is the provision of an electrically insulating hand tool which is of relatively simple design and economical structure.

Another feature is the provision of an electrically insulating hand tool that provides greater safety when used on or around sources of electricity.

Another feature is the provision of an electrically insulating hand tool that is lightweight yet sturdy.

Another feature is the provision of an electrically insulating hand tool with interchangeable work-engaging heads.

In connection with the foregoing features, yet another feature is the provision of a method of making an electrically insulating hand tool with the features stated above.

BRIEF DESCRIPTION OF THE DRAWINGS

For the purpose of facilitating an understanding of the subject matter sought to be protected, there is illustrated in the accompanying drawings an embodiment thereof, from an inspection of which, when considered in connection with the following description, the subject matter sought to be protected, its construction and operation, and many of its advantages should be readily understood and appreciated.

DETAILED DESCRIPTION

Figure 1:
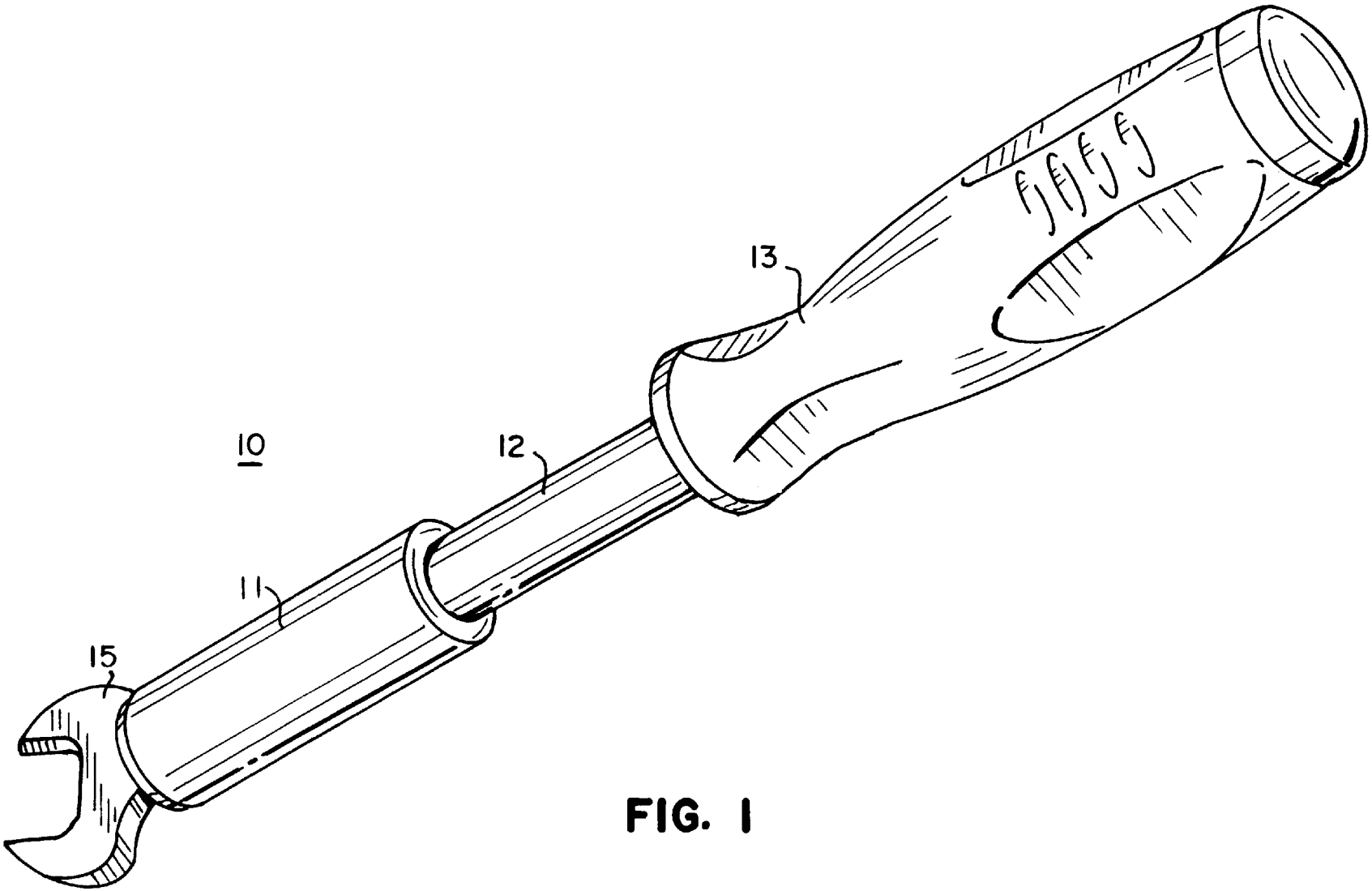
FIG. 1 is a perspective view of an embodiment of an electrically insulating hand tool.
Figure 2:
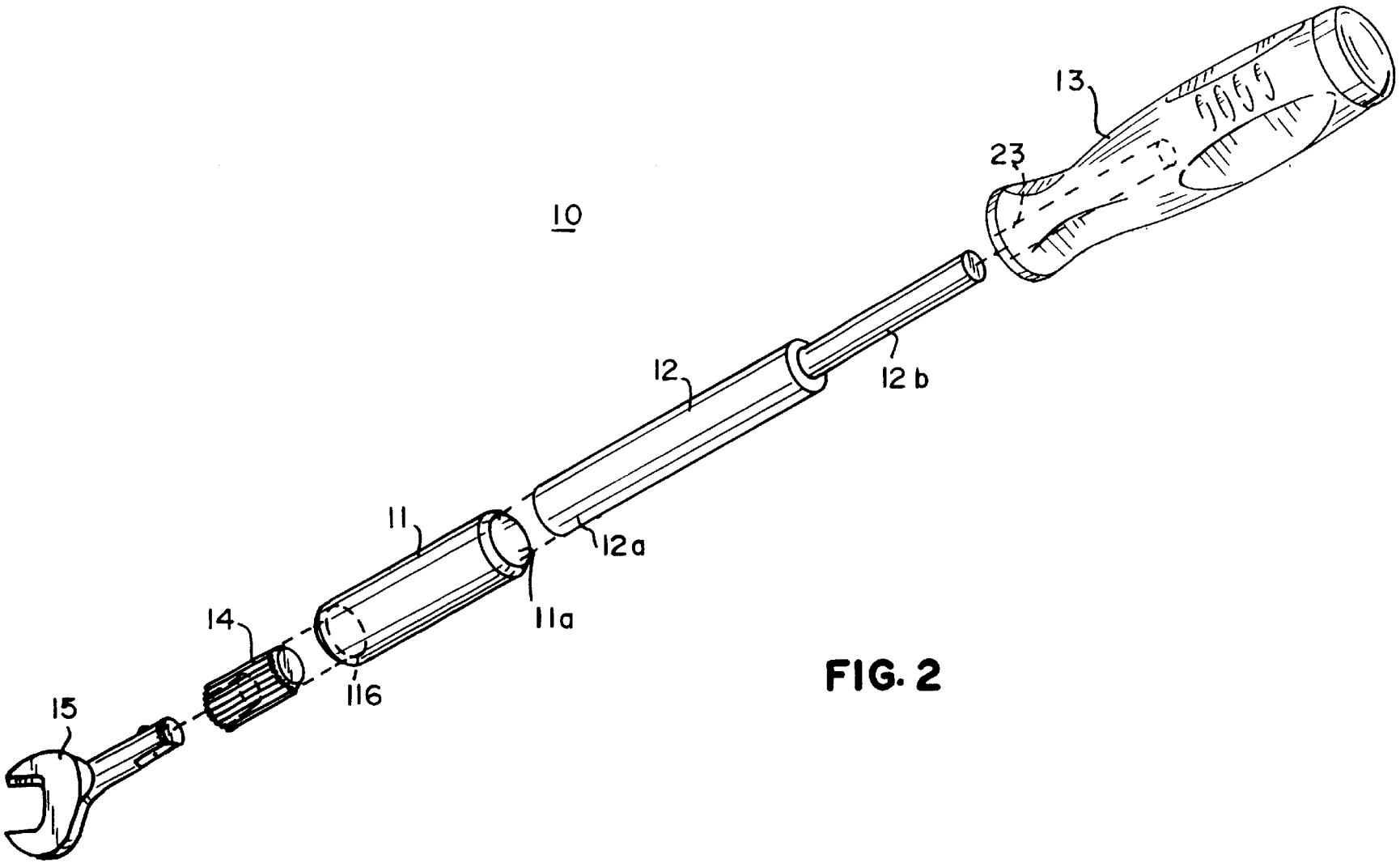
FIG. 2 is a reduced, exploded, perspective view of the embodiment in FIG. 1 revealing underlying structure.

Referring to FIGS. 1 and 2, there is illustrated an electrically insulating hand tool, generally designated by the numeral 10. The hand tool 10 is comprised of a two-piece shaft formed by a tube 11 and a rod 12 received by the tube 11, a handle 13 connected to the rod 12, an insert 14 received in an end of the tube 11 opposite the rod 12, and a work-engaging head 15 detachably coupled to the insert 14. For the purpose of illustration, the embodiment shown is configured as an open end wrench. However, it can be appreciated that the electrically insulating hand tool may be configured to perform a variety of different functions by simply uncoupling the work-engaging head 15 and interchanging with a differently configured work-engaging head.

The tube 11 and the rod 12 may be formed of an electrically insulating, non-metallic, composite material. In this embodiment, the tube 11 is formed of a composite material including alternating layers of braided glass fibers in an epoxy resin matrix. The rod may be made of a pultruded glass/polyester composite material.

The tube 11 is hollow along its entire length, and adhesively receives the rod 12 at one end 11*a* to form the shaft. The rod is machined so that its end 12*a* received by the tube 11 has a greater diameter than the opposite end 12*b*. The shaft is able to apply high rotational torque energies to the work-engaging head, without causing the nonmetallic composite materials which form the tube 11 and the rod 12 to deform or bend. Consequently, the combination of the two piece shaft construction and the use of nonmetallic composite materials allow the hand tool 10 to apply greater torque pressures, with significantly greater electrical insulating properties, and reduced weight.

Figure 3:
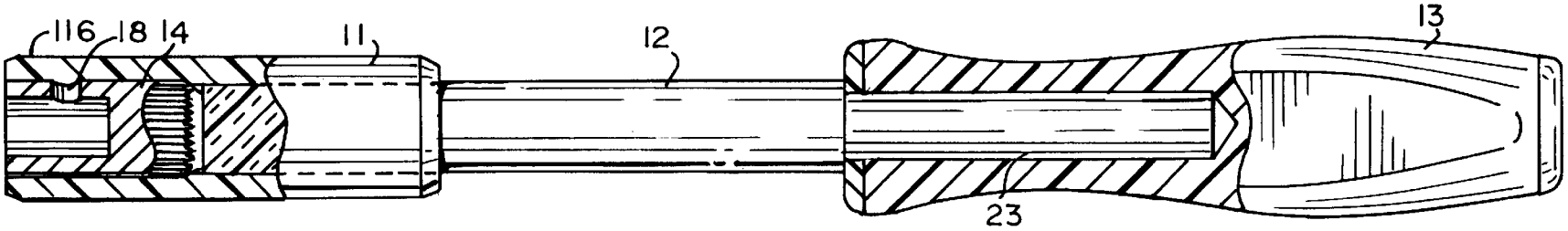
FIG. 3 is a side elevational view of the embodiment in FIG. 1 with the head removed and portions sectioned to reveal underlying structure.
Figure 5:
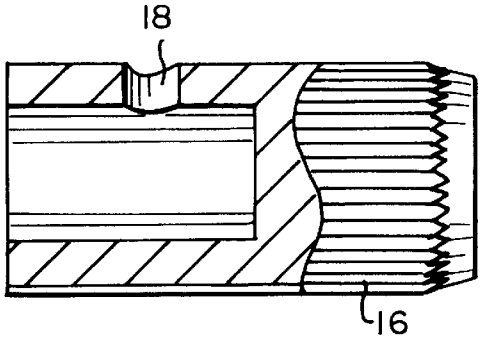
FIG. 5 is an enlarged side elevational view in partial section of the insert in FIG. 3 revealing underlying structure.
Figure 4:
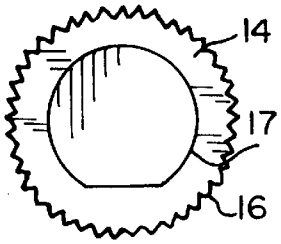
FIG. 4 is an enlarged end elevational view of the insert in FIG. 3.
Figure 9:
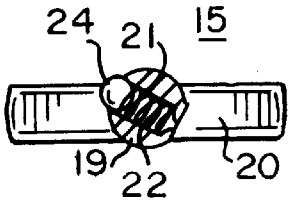
FIG. 9 is a section view of the work-engaging head in FIG. 1 taken along the line 9—9 in FIG. 7.
Figure 6:
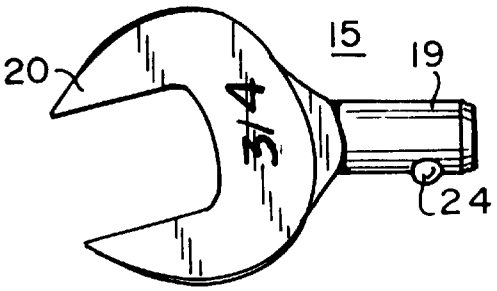
FIG. 6 is a top plan view of the work-engaging head in FIG. 1.
Figure 7:
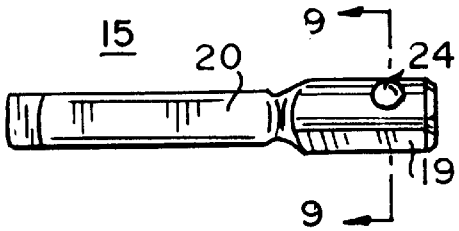
FIG. 7 is a side elevational view of the lower side work-engaging head in FIG. 1.
Figure 8:
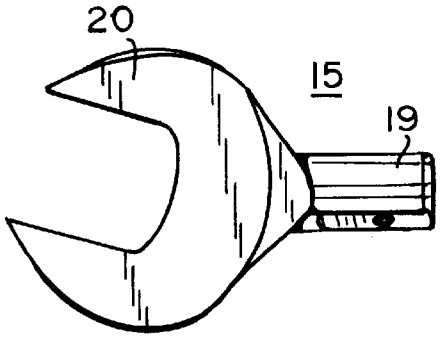
FIG. 8 is a bottom plan view of the work-engaging head in FIG. 1.

Referring to FIGS. 3, 4, 5, in this embodiment, the insert 14 is a cylindrical structure having a recess therein and a plurality of knurls 16 extending longitudinally along its outer surface. The knurls 16 provide a frictional force to inhibit relative rotation between the insert 14 and the tube 11. The internal surface of the insert 14 defines a cavity 17 with a generally D-shaped transverse cross section, sized for receiving and coupling the work-engaging head 15. An aperture 18 extends through a side of the insert 14.

Referring to FIGS. 6, 7, 8, 9, the work-engaging head is comprised of a shaft portion 19 and a work-engaging portion 20. The work-engaging portion 20 may be coated with an electrically insulating sheath to protect against shorting of electrical components. In this embodiment, the work-engaging portion 20 is configured as an open end wrench.

However, it can be appreciated that the work-engaging portion 20 can be otherwise configured to perform a variety of other functions.

The shaft portion 19 has a portion with a D-shaped cross-section correspondingly sized to allow insertion within the D-shaped cavity 17 of the insert 14. A detent recess is formed in the shaft portion 19 and houses a spring 22 and has a detent ball 24 partially projecting from the recess. The detent mechanism 21 is positioned along the shaft portion 19 to enable the ball 24 to detachably couple in the aperture 18 located on the insert 14.

Referring to FIGS. 2 and 3, the handle 13 is made of an electrically insulating material and is ergonomically designed to accommodate a user's hand. A bore 23 extends within the handle, and receives the end of the rod 12 opposite the tube 11.

Referring to FIG. 1, one method of constructing the electrically insulating hand tool involves press fitting an insert 14 into an end 11*b* of the tube 11. A rod made of a composite material is machined so that one end 12*b* has an external diameter sized for insertion into the bore 23 within the handle 13. This end 12*b* is adhesively secured within the bore 23 in the handle 13, and the opposite end 12*a* of the rod 12 is adhesively secured within an end 11*a* of the tube 11 opposite the insert 14. A work-engaging head 15 can then be detachably coupled to the insert.

The matter set forth in the foregoing description and accompanying drawings is offered by way of illustration only and not as a limitation. While a particular embodiment has been shown and described, it will be obvious to those skilled in the art that changes and modifications may be made without departing from the broader aspects of applicants' contribution. The actual scope of the protection sought is intended to be defined in the following claims when viewed in their proper perspective based on the prior art.

What is claimed is:

1. An electrically insulating tool comprising:

a shaft formed from a hollow tube and a rod, one end of the rod received in one end of the tube, the tube and the rod formed of an electrically insulating non-metallic material;

an electrically insulating handle connected to the rod at an end opposite the tube;

an insert received in an end of the tube opposite the rod and having therein a cavity generally D-shaped in transverse cross section;

a work-engaging head receivable in the cavity and detachably coupled to the insert, and an electrically insulating sheath covering the head.

2. The tool of claim 1, wherein the insert has an aperture therethrough and the head has a spring-loaded ball detent which detachably engages in the aperture.

3. The tool of claim 1, wherein a plurality of knurls extend longitudinally along an outer surface of the insert.

4. The tool of claim 3, wherein the insert is press fit into the tube.

5. The tool of claim 1, wherein the work-engaging head is configured as an open end wrench.

6. The tool of claim 1, wherein the tube is made of a composite material including alternating layers of braided glass fibers in an epoxy resin matrix.

7. The tool of claim 6, wherein the rod is made of a pultruded glass/polyester composite material.

8. The tool of claim 7, wherein the rod is adhesively secured in the tube.

9. The tool of claim 8, wherein the rod is adhesively secured to the handle.

10. An electrically insulating open end wrench comprising:

a shaft formed from a hollow tube and a rod adhesively received in one end of the tube, the tube made of a composite material including alternating layers of braided glass fibers in an epoxy resin matrix and the rod made of a pultruded glass/polyester composite material;

an electrically insulating handle receiving therein an end of the rod opposite the tube;

an insert press fit in an end of the tube opposite the rod and having therein a cavity generally D-shaped in transverse cross section and an aperture extending through the insert and communicating with the cavity;

an open end wrench head receivable in the cavity and detachably coupled to the insert and including a spring-loaded ball detent positioned on the head to detachably engage in the aperture, and an electrically insulating sheath covering the head.

11. The wrench of claim 10, wherein a plurality of knurls extend longitudinally along an outer surface of the insert.

12. The wrench of claim 10, wherein the rod is adhesively secured to the handle.

* * * * *

UNITED STATES PATENT AND TRADEMARK OFFICE

CERTIFICATE OF CORRECTION

PATENT NO. : 6,408,723 B1
DATED : June 25, 2002
INVENTOR(S) : Zurbuchen, G.

It is certified that error appears in the above-identified patent and that said Letters Patent is hereby corrected as shown below:

Title page,
Item [54], Title, "INSULATING COMPOSITE SHAFT TOOL WITH INTERCHANGEABLE HEADS AND METHOD OF CONSTRUCTION THEREOF" should be -- INSULATING COMPOSITE SHAFT TOOL WITH INTERCHANGEABLE HEADS -- .

Signed and Sealed this

Twenty-first Day of January, 2003

JAMES E. ROGAN
*Director of the United States Patent and Trademark Office*